US005957501A

United States Patent [19]

van Ardenne

[11] Patent Number: 5,957,501

[45] Date of Patent: Sep. 28, 1999

[54] COVER FOR HOLDING TOGETHER SHEETS OF PAPER, AS WELL AS A BUNDLE OF SHEETS OF PAPER

[75] Inventor: Robertus A. M. van Ardenne, Amersfoort, Netherlands

[73] Assignee: Ardebridge B.V., Amersfoort, Netherlands

[21] Appl. No.: 09/156,070

[22] Filed: Sep. 17, 1998

Related U.S. Application Data

[63] Continuation of application No. PCT/NL97/00147, Mar. 20, 1997.

[30] Foreign Application Priority Data

Mar. 29, 1996 [NL] Netherlands ..... 1002742

[51] Int. Cl.[6] ..... B42D 3/00

[52] U.S. Cl. ..... 281/45; 281/21.1; 281/29

[58] Field of Search ..... 281/15.1, 19.1, 281/20, 21.1, 24, 29, 37, 42, 45

[56] References Cited

U.S. PATENT DOCUMENTS

| | | | |
|---|---|---|---|
| 964,895 | 7/1910 | Bernhardt | 281/20 |
| 2,275,927 | 3/1942 | Thomas . | |
| 4,402,530 | 9/1983 | Daguerre | 281/45 |
| 4,904,104 | 2/1990 | Gloeckle | 402/80 R |
| 5,472,238 | 12/1995 | Sato | 281/45 |
| 5,685,569 | 11/1997 | Chon | 281/21.1 |

FOREIGN PATENT DOCUMENTS

| | | |
|---|---|---|
| 517106 | 2/1953 | Belgium . |
| 0713787 A2 | 5/1996 | European Pat. Off. . |
| 3718664 A1 | 12/1988 | Germany . |
| 87051 | 5/1921 | Switzerland . |

*Primary Examiner*—Willmon Fridie, Jr.
*Attorney, Agent, or Firm*—Hoffmann & Baron, LLP

[57] ABSTRACT

Cover (1) for holding together sheets of paper, which cover is provided with one or two scored grooves (4) for forming a spine by folding over, so that the contents (8), in the form of the sheets to be held together, are enclosed between a front leaf (2) and a back leaf (6), the front leaf (2) being provided near the spine with an incision, such that a part or lip (7) which is attached to the spine of the back leaf, respectively, but is otherwise free, is formed, which part or lip is suitable for retaining the contents (8) while the remaining part of the front leaf (2) and the contents can be opened, characterized in that the lip (7), attached to the (first) score line (4), is formed in the corner region near the top edge (5), running from the score line (4) or from the first score line in the direction of the top edge (5). Bundle of sheets of paper, intended to be folded together in two to form a booklet, optionally sealed with a cover, all the sheets being cut into a corresponding manner, as indicated above.

13 Claims, 5 Drawing Sheets

COVER FOR HOLDING TOGETHER SHEETS OF PAPER, AS WELL AS A BUNDLE OF SHEETS OF PAPER

This application is a continuation International Application No. PCT/NL97/00147, filed on Mar. 20, 1997, and which designated the U.S.

FIELD OF THE INVENTION

The invention relates to a cover for holding together sheets of paper, as well as a bundle of sheets of paper.

BACKGROUND OF THE INVENTION

It takes considerable time to write a good report or tender, and its presentation is equally important since, when information in paper form is sent out or offered, first impressions determine to a considerable extent whether the recipient will continue reading it. After all, people have to make choices, for they often cannot read through everything which they receive, because ever more information is being sent. To put it briefly, the appearance—that is to say the packaging of the information—must look tidy and distinguishing and, as it were, compel further reading.

The progress of automation means that more and more people work in businesses with a PC and printer and will more and more have to or wish to bind the printed material themselves to form a presentable package. A large number of covering and binding systems are known for packaging loose leafed information, or actually binding it to form a small book with a rigid cover. A number of these can be carried out exclusively by professional binders in the graphics industry (for example fastening a number of sheets on a score line, as is used in periodicals), since specialist equipment is required. There is a considerably smaller number of options available to office workers, and these often require many operations and thus take a relatively large amount of working time, and as a consequence are extremely costly. This is particularly true of letters or reports comprising a smaller number of pages, since the number of operations and the possible waiting time remains the same whether 15 pages or 45 pages are being bound. Furthermore, it has emerged in practice that a considerable number of letters, contracts, reports, tenders, statements, budgets, etc. of 10 to 15 pages are being produced.

One of the binding methods used in offices for this purpose is the A3-cover made of plastic and/or cardboard, the spine of which is provided on the inside with a thermoplastic adhesive, by means of which the loose A4 sheets can be glued together in the spine. Another known method is the spiral binding of loose pages by means of a plastic or metal spiral in the left-hand margin of the page, having an A4 board on the front and back sides of the booklet as a finishing means. Still further methods are based on holding together loose pages by means of one, two or more perforations in a cover, usually having a transparent front. Yet another known method is to fasten together loose pages at two points near the score line in an A3 cardboard cover which has been folded in two. Naturally, each method has its own charm and characteristics which benefit or impair the user's impression and the ease of use, including the ease of reading and leafing through.

A drawback of the "glued spine cover" is that it requires a special heating apparatus, which is generally not within the immediate reach of everyone in an office environment. Various files are available, each having a characteristic spine thickness, in which a certain maximum number of sheets can be glued. The drawback of these is that the spine is virtually always too high. Furthermore, heating up the apparatus and heating the glued spine to the operating temperature require some minutes of costly working time. After binding, a period of a few minutes is again required, for which purpose the bound file has to be put down again at another location in order to cool. The user will thus have to walk to and fro from his/her workstation to the apparatus or remain waiting at the apparatus. These aspects make the use of glued spine covers extremely laborious and costly with regard to the working time taken up. Moreover, there is a risk that the apparatus will already be in use, necessitating yet more waiting or walking. The solution to this is to provide more apparatus, or automatic apparatus, but this is an expensive solution, resulting in higher investment and depreciation, yet more maintenance, power consumption, more intermediate stocks, more space taken up at more workstations, and yet no improvement in the binding result.

A specific drawback of the "spiral method" is that in particular thin reports, even when bound with the thinnest spiral in order to provide a pleasant cover sheet, require a relatively thick spine, which causes problems during dispatch, filing and stacking. Different spiral sizes entail stock control. Also, a specific apparatus, which is always situated away from the workstation, is used to attach the spiral, which again represents a considerable (hidden) drawback due to inefficient use of time. This makes spiral binding expensive, even though the spirals themselves are relatively cheap.

A significant drawback common to the covers, although to a lesser extent for the "attached cover", is that it is unsuitable, from the point of view of style, ease of reading and aesthetic considerations, to use the said covers for presenting an offering of only a few pages. A three-page letter simply does not fit aesthetically in a glued spine, spiral or perforated cover. Yet another drawback for the glued spine, attached and perforated cover is that each page first has to be folded flat over the entire length after turning over. Otherwise the tender will continuously fall or snap shut automatically. This takes up the time, attention and effort of the reader, which is of course detrimental to reading the contents. Moreover, in all these binding methods a significant part of the left-hand blank margin is lost precisely as a result of the binding and in particular with a second page after the top page has been folded over. Additionally, there is the risk in the glued spine cover that the sheets will come unstuck during folding or copying. A further drawback common to these binding methods is that it is difficult and/or laborious, or even impossible, to return material which has already been bound to a loose-leafed form, let alone to reuse it decently, since the loose pages are damaged either by holes or by residues of adhesive. It would be useful to be able to do this in practice, for example for a data compiler, in order to be able to exchange even one page containing an error or in order to be able to add a page. In practice, the report is often reprinted (waste of time, toner and paper), rebound and the old covers and their contents, etc. have to be placed in the waste paper. Another drawback common to all known methods is the problem of accommodating the covers in a document file. In the case of the attached and perforated covers, this is because the places where the holes need to be made are already occupied and the cover will thus have to be removed first. This also applies to the spiral cover, owing to the thickness of the spiral. Although the glued spine cover is not subject to this problem, it has the drawback that the cover will first have to be taken out of the document file before it becomes easy to read and leaf through.

The invention takes as the state of the art upon which the precharacterizing parts of claims 1 and 6, respectively, are readable, U.S. Pat. No. 4,402,530, to wit FIGS. 1 and 2, respectively, thereof.

The object of the invention disclosed in the just-mentioned U.S. patent was to eliminate these drawbacks to a large extent, or completely, and to provide a new principle for a cover which is user-friendly and can be attached quickly and easily, sitting behind a desk, without requiring a machine.

According to this U.S. patent publication two lips are formed in the cover by means of incisions (FIG. 1) or two cut-outs are made (FIG. 2), both along the length of the spine. In this way the contents can be held together from the spine. This is done by means of a pair of resilient steel clips having operating arms, these clips being of the so-called butterfly type. The lip thus formed or the cut-out formed extends up to the last scored groove, so it is contiguous with the back leaf. As a consequence of this, the lip will always present a series of score lines. At the front the apertures created should have such dimensions that when opening the front leaf, the upper operating arm can be passed freely.

From the point of view of the present invention this system presents a number of disadvantages, the most important of which are the following:

The clips will make the entire left hand margin of all sheets comprising the contents, except the first sheet, invisible by the previous sheet.

The margin area thus covered ("blind" area) is made wider yet by the embodiment having the lips below the clips proper, so that in many cases even text within a generally accepted type page will be covered partly.

This phenomenon still increases to the extent that the reader will leaf through the contents because each successive sheet is turned over at an increasing distance from this point.

The just mentioned disadvantage can only be kept at a minimum by folding each sheet as sharp as possible; not only will this cause some trouble, but it will also result in all sheets, after taking the bundle of sheets apart—which, according to the purpose of the system, is to remain possible—will present a fold.

The pages which have been turned over will, despite folding, remain inclined to fall back again, so that reading must be interrupted from time to time in order to prevent this closing of the reading matter, or one must actively keep the booklet open, which detracts from attention to the reading.

In order to ensure that, when the front leaf of the cover is opened, the upper most operating arms will be passed freely, the clips must be pushed on entirely up to the spine and they should remain in this position. This requires means such as an embossed portion or a narrow slot. It also entails that the clips must be placed carefully.

It is required to always use two clips, which entails double labour.

SUMMARY OF THE INVENTION

The cover according to the invention in its basic idea is characterized in that the front leaf being provided, in the corner region near the top edge, near the pine with an incision running from the score line—or from the first score line—in the direction of the top edge, such that a part or lip which, the (first) score line, is attached to the spine or the back leaf, respectively, but is otherwise free, is formed, which part or lip is suitable for retaining the contents while the remaining part of the front leaf and the contents can be opened, characterized in that the lip, attached to the (first) score line, is formed in the corner region near the top edge, running from the score line—or from the first score line—in the direction of the top edge.

For the purpose of binding, the invention makes use of the generally known binding principle of the paper clip. As a result, binding becomes quick, easy and reliable. The amount of paper which can be bound depends on the type of paper clip used. To provide for efficient posting and dispatch, the file can be provided with an address window.

When the front leaf is opened along the spine line, the sheets of the contents can be opened successively over about 45° around the corner region of the half-attached part. This is situated outside the generally accepted type page. As a result, in contrast to the various known binding systems described above, the entire left-hand margin is completely visible, not only for the first page of the contents but for all further pages. The pages of the contents can be turned over in an entirely natural manner about a region in the top left-hand corner, without the necessity of folding, and without the turned pages being inclined to fall back and close again. The system remains effective, also when the paper clip is put on slightly obliquely or is not pushed on completely.

It is possible to use any type of paper fastener for the inventive idea. However, significant advantages are provided by the use of a commercially available clip such as that which is described in EP-A1-0,525,909. One of the many advantages, described extensively in these patent applications, is that a logo can be printed on this clip which, when used in combination with the present inventive idea, provides a clear function of attracting the attention.

In accordance with the same inventive idea, it is also possible to design a bundle of sheets of paper which is intended to be folded over together to form a booklet, optionally sealed with a cover. Such a bundle of sheets is characterized in that an incision, running from the line which is intended to be the fold line, is made in all the sheets and, if required, the cover in a substantially identical manner in the corner region near the top edge of the sheet half which is intended to form part of the front half of the booklet, such that a part is formed which remains attached to the sheet half which is intended to form part of the rear half of the booklet but is otherwise free, which part is suitable, after the bundle has been folded together in two, to hold this bundle together in the front half of the booklet, while the page halves can be opened.

Various embodiments based on the same principle are possible.

In most cases, it will be preferred if the paper fastener or clip is pushed on from the top. However, an embodiment is also possible in which a paper fastener can be pushed on from the side of the spine, but always in the top corner region.

The invention will be explained below with reference to a number of exemplary embodiments.

DETAILED DESCRIPTION OF THE INVENTION

Figure 1:
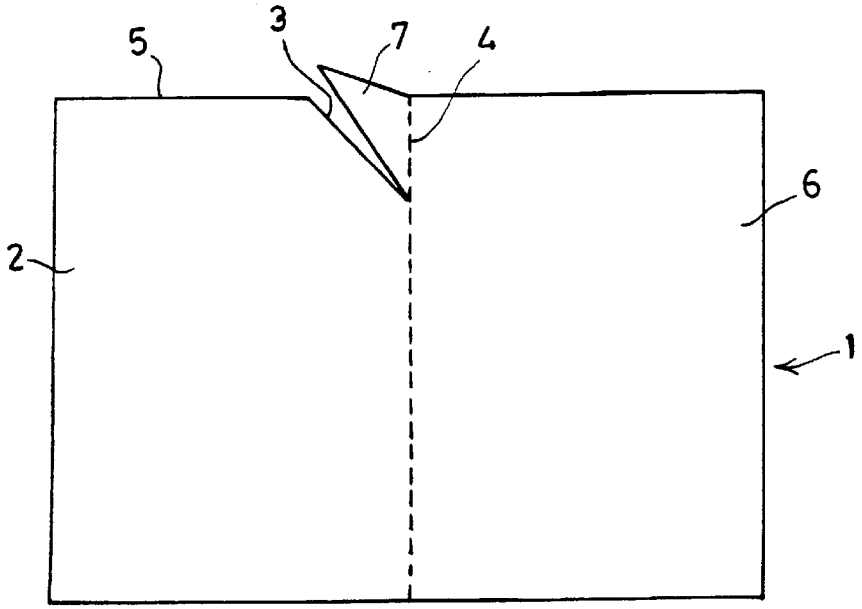
FIG. 1 is a view of the inside of a cover having an incision and a semi-detached lip in accordance with the invention.

The principle is explained with reference to FIG. 1, in which a number of sheets of A4 paper are to be bound in an A3 cover folded in two. The cover 1 is made suitable for this purpose by making an incision 3 in the front leaf 2. In this embodiment, the incision begins at the score line 4, which serves to form the spine, and runs in a straight line as far as the top side 5 of the front leaf.

This results in the formation of a part or lip 7 which remains attached to the spine or back leaf 6, respectively, but is otherwise free.

Figure 2:
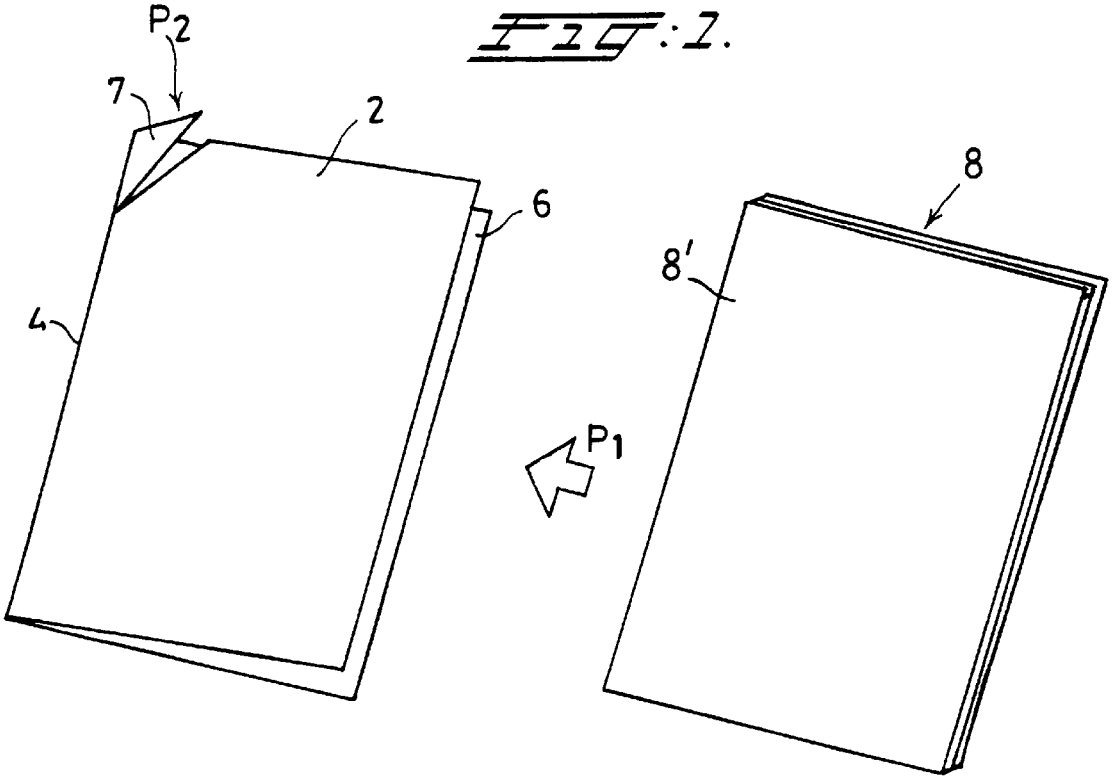
FIG. 2 diagrammatically shows how contents are inserted into the cover.
Figure 3:
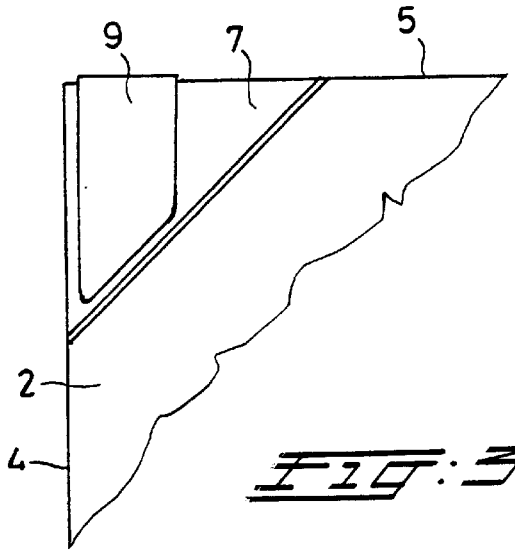
FIG. 3 shows, on an enlarged scale and approximately in accordance with an actual embodiment, the left-hand top corner of the front of the folded cover.

If, as sketched in FIG. 2, the contents 8, in the form of a stack of loose sheets 8' of A4 paper, is thus inserted into the cover, which has been folded along the score line 4, in the direction of the arrow P1, the free part 7 can be used to secure the said contents 8 with respect to the back leaf 6, by sliding on a paper fastener 9, preferably from the top side in the direction of the arrow P2, as illustrated in FIG. 3. That part of the front leaf 2 which remains apart from the loose part 7 can then be opened along the spine, which is formed by the score line 4, without adversely affecting this securing, so that the entire contents a remain immovable with respect to the back leaf 6. The separate sheets of the said contents can then be opened in the top left-hand corner about the lip 7 in the corner region which is retained by the slid-on paper fastener, as indicated diagrammatically in FIG. 4. This provides a so-called turn-over and folding edge which allows an opened page to be turned over and rest extremely naturally while joined at the top left-hand corner to one or more other pages.

Figure 4:
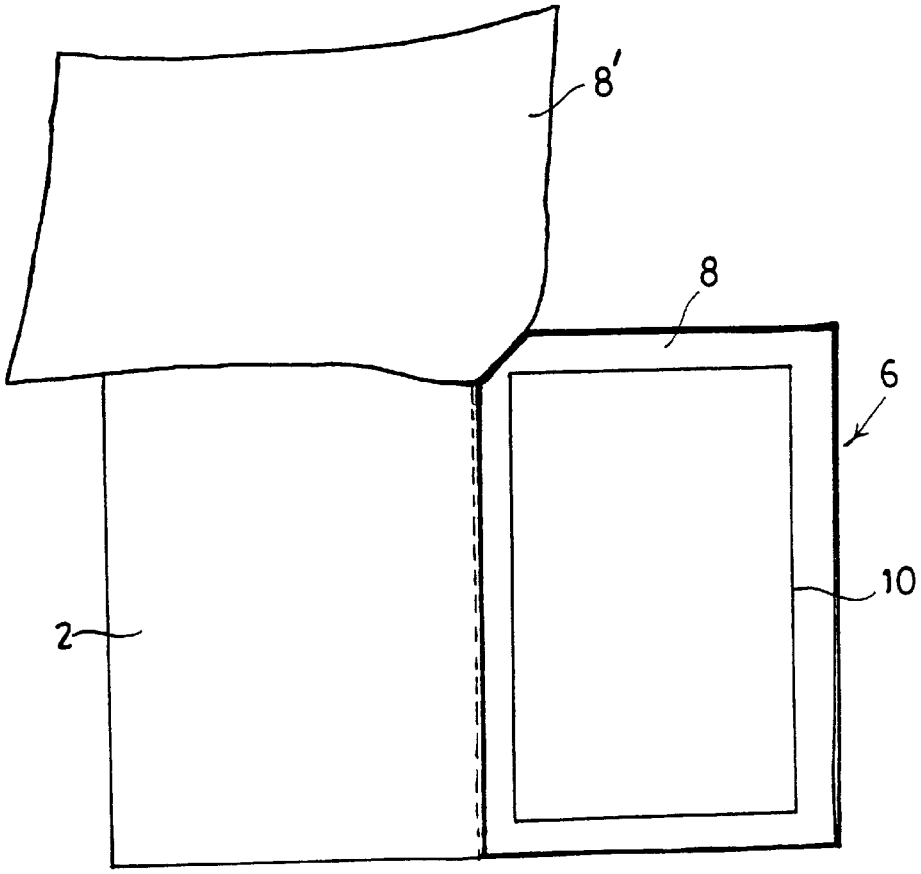
FIG. 4 shows how, when the cover is open, separate sheets of the contents can be folded open about the left-hand top corner, with a view to reading.

FIG. 4 also shows, at a more or less customary location, a type page 10 on the visible sheet of the contents. It can be seen from this that the turned-over section at the sheets, such as 8', affects only a corner region of the paper format, in the top left-hand corner, which is entirely outside the normal type page 10. It is this dimension which is decisive for the positioning of the cut 3. The line about which the pages such as 8' are eventually folded over is determined, in the case of the straight incision in accordance with FIGS. 1 to 3, by the oblique side which then remains of the triangular lip 7.

Preferably, the cover is used in combination with a paper-clip on which a logo can be printed and which does not damage the cover and the paper. This clip, shown in FIG. 3 as clip 9, is known from EP-A1-0,525,909. As a result, it is not necessary to print directly on the cover itself in order nevertheless to be able to provide differentiation between organizations. Moreover, the file is not damaged by using the said paper clip which can be printed, and the file and its contents remain completely flat.

The front leaf 2 of the cover 1 is preferably one or a few mm wider, at least with regard to the width up to the score line 4, than the back leaf, with a view to facilitating opening of the folded cover 1.

Figure 5A:
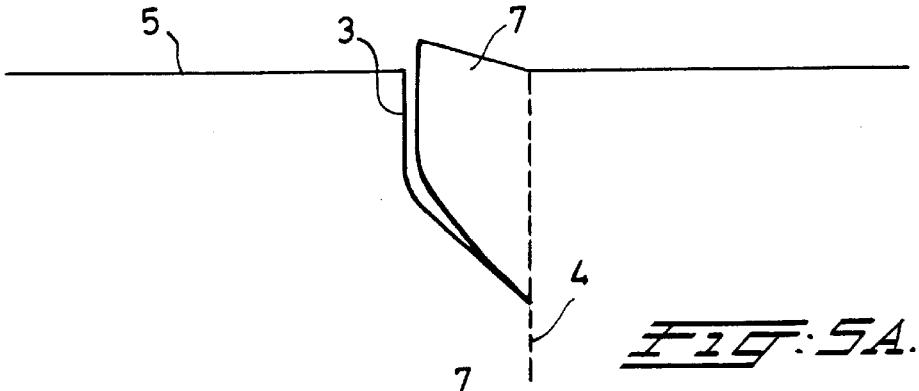
FIGS. 5A to 5D inclusive show, on an enlarged scale, various embodiments of the incision in accordance with the invention.
Figure 5B:
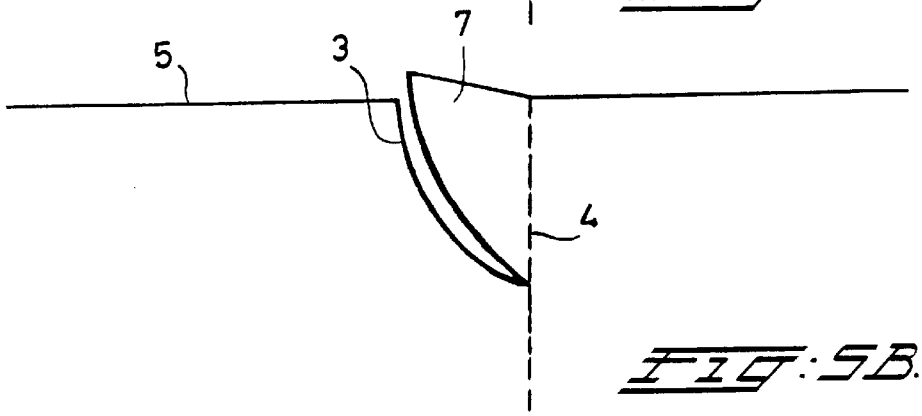
Figure 5C:
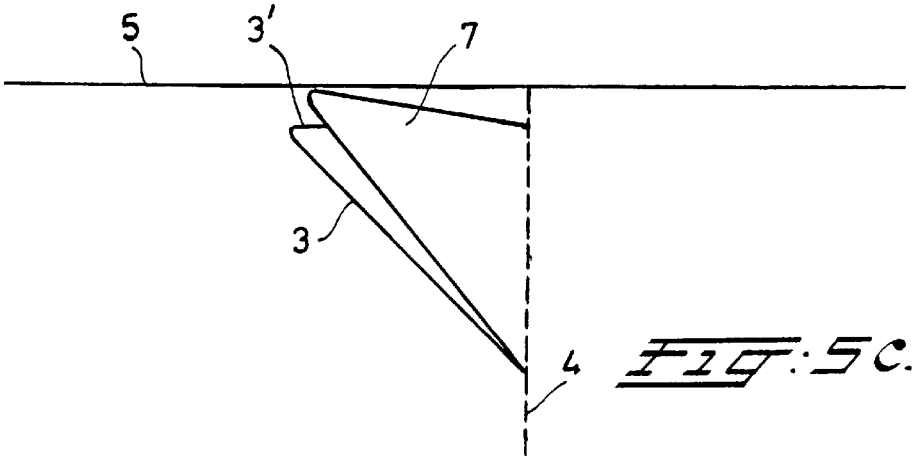

FIGS. 5A to 5D inclusive show a series of variants of the way in which the cut is made and the way in which the object of the invention can likewise be achieved. FIG. 5A shows a cut 3 which first runs obliquely upwards and then runs straight towards the top edge 5. In FIG. 5B, the cut 3 is entirely curved but again continues to the top edge. FIG. 5C shows an incision 3 which initially runs in the direction of the top edge 5 but which is adjoined by a second part 3' which runs back towards the score line 4. This results in a part 7 which is joined to the back leaf 6 just at the location of the score line 4, but which is accessible from the spine and not from the top, as in the other embodiments, before sliding on a paper fastener (see FIG. 3).

When forming the incision in accordance with FIGS. 5A and 5B, folding takes place practically about that point of the lip part 7 which, approximately in the diagonal direction over the page, lies furthest from the corner point (thus the location where the spine formed by the score line 4 reaches the top side 5). In the variant embodiment in accordance with FIG. 5C, a line at approximately 45° is available for folding over, in the same manner as in FIGS. 1–3. In the embodiment in accordance with FIG. 5D, no lip 7 remains to determine the folding line. In that case, the folding line is determined by the shape and the furthest projecting point of the paper fastener used, possibly by an attached staple, if the user is giving priority to inexpensive execution.

It will become clear below that it is best for the incisions 3 to begin from the score line 4 in a direction running somewhat obliquely towards the top edge 5. A part of the incision which initially runs parallel to the top edge 5 is possible, but it has the drawback that as a result the folding line is further from the corner point so that, for the same end result, the starting point of the incision would actually have to be higher than in the case of the embodiments as depicted.

Figure 5D:
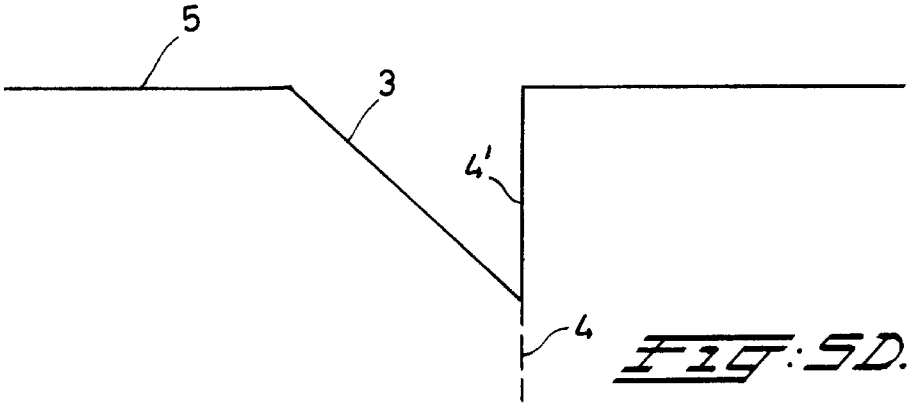

Finally, FIG. 5D shows an interesting variant embodiment of the same basic idea, in which in addition to the obliquely running cut 3 an additional cut 4' is made as an extension to the score line 4. As a result, a substantially triangular piece of material is completely removed instead of remaining attached to the spine or the rear flap. After folding over and introducing the contents, the said contents can still be secured in the desired manner in the top left-hand corner, at the location of the removed corner of the front leaf, by means of a paper fastener, such as the fastener 9 of FIG. 3 or any other paper fastener.

Moreover, it is pointed out that although the invention provides an aesthetically attractive result when the paper fastener in accordance with the said Dutch and European patent applications is used, as illustrated in FIG. 3, other paper fasteners can also be used, in particular the traditional paper clip.

In relation to the paper format which is to be bound, it is preferred that the width of the back leaf 6 be selected to be at least a few mm wider than the width of the paper and that the height of the cover should be at least as high as the paper, but preferably the height of the cover is selected to be 1 to a few mm greater. The following dimensions thus apply to an A3 cover in accordance with the inventive idea, intended for binding A4 format: 301 mm (height)×431 mm (width), the score line 4 being positioned such that a front leaf 2 and a back leaf 6 are formed having a width of 216 and 215 mm, respectively, thus with an overlap of 1 mm, and a free part 7 in the form of an isosceles triangle having right-angle sides of 40 mm.

The contents are preferably inserted with the bottom edge on a table, so that the bottom edge of the paper and the cover assume a straight and smooth position.

The advantage of the file is that information which has already been bound can be reordered quickly and easily, making the binding much cheaper. Pages remain undamaged and exchangeable, resulting in quick and easy changing of the contents. There is no problem at all in adding an extra page or loose memo. Another advantage is that the thickness of the cover is always directly related to the amount of bound material. The cover is thus never thicker than necessary. The file having a single score line has a capacity of 1 to about 20 pages. A second score line is necessary for thicker stacks.

Another advantage is that the clip file remains very flat and thus is easy to stack. This means that stacks do not fall over, envelopes are less thick, and there are lower stacks for mailings. Separate folders can be inserted by leaving the back leaf free during binding. The file falls open on the opened page and remains open without having to fold the sheets. The file is completely reusable and can easily be separated into clips, paper and cardboard for waste processing. Thus there is no plastic or residues of adhesive to be burnt or dumped and no power consumption (environment) during binding.

Figure 6:
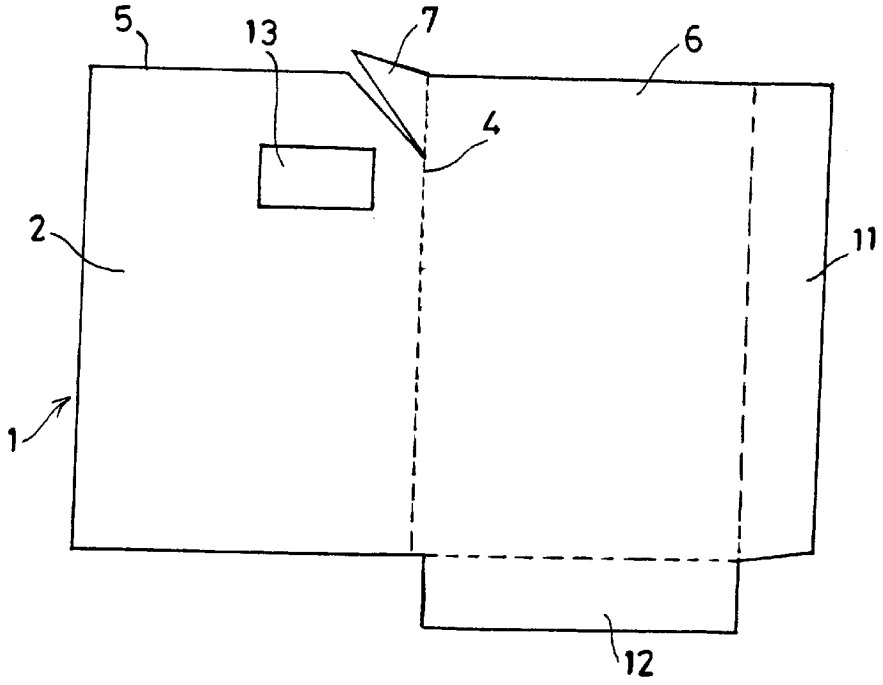
FIG. 6 shows an embodiment of a cover according to the invention, provided in a manner known per se with flaps and a window.

Another embodiment of the cover according to the same operating principle is shown in FIG. 6. This cover is provided with the known side flap 11 and bottom flap 12, in order to be able to append separate information or photographs in the file, that is to say material which should not be joined to the rest of the contents in the top left-hand corner. The shape and dimensions of the flaps are chosen arbitrarily without limiting the inventive idea to this shape.

Using flaps has several consequences: the height of the front leaf 2 and as regards the back leaf 6 as far as the score line 4 should preferably be selected to be greater than for the cover without flaps, in order to prevent inserted pages from projecting. The width of the back leaf of the cover with flaps should preferably be selected to be at least 2 mm wider.

Another consequence of making use of the possibility of insertion behind the flaps is that the clip or the staple must not be placed around or through the back leaf 6, but behind or through the last page which is bound. This is necessary in order to be able to open the back leaf to remove the separate information.

Another possible form of the cover is one in which the single score line is replaced by a pair of score lines, in order to improve the folding, and generally for relatively thick contents.

It can also be seen from FIG. 6 that the front leaf 2 of the cover 1 may be provided, in a manner known per se, with one or more window-like cutouts 13, through which part of the information on the first page to be bound is made readable; this may, for example, be the address of the person for whom the item is intended.

In order to facilitate storage of the tenders and reports, the file may be provided with punched filing holes. One or more punched filing holes are made close to the score line or fold, at the standard centre distances which apply nationally or internationally (80 mm for 2-hole document files), preferably in the back leaf of a cover, such that the document file tab which results, and which is delimited by the punch line and the score line, is not quite stamped out at at least one point in the back leaf, by means of a recess in the punching blade. In addition, a perforation is punched in the tab, the material of which perforation, also preferably by means of at least one punched recess, has to remain attached to the tab until the hole is actually used. The document is placed in a document file by deliberately breaking the punched recesses of the tabs using one's fingers, as a result of which the tabs can then be folded along the score line out of the outline of the file.

Figure 7:
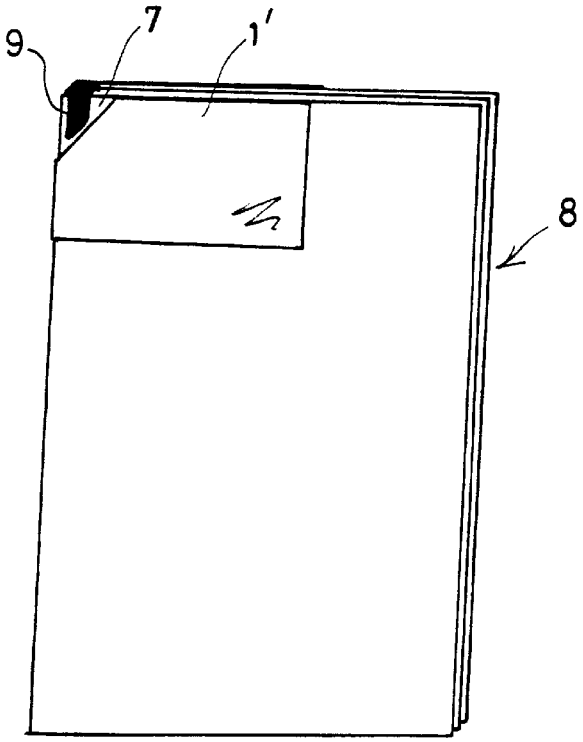
FIG. 7 shows a bundle of sheets of paper, provided with a cover according to the invention of a smaller format than the sheets of paper held together.

Obviously, the principle of the invention which has been outlined so far can be used for all kinds of cover and paper formats. Also, it is by no means necessary for the cover to be twice the size of the sheets to be bound together. The term "cover" is understood in the context of the present patent application to include pieces of paper or plastic which are to be folded in two or have been folded in two which will be smaller, even considerably smaller, than the paper which is to be held together, as is illustrated in FIG. 7. In this case, the dimensions of the cover 1' are only a fraction of the paper format around which it is placed, but the effects of arranging a part 7 which is only half-attached remain the same: the front leaf of the cover can be folded away while the sheets of paper 8 are held together by an attachment means, such as clip 9, which in this case also retains the half-detached lip 7. In this way, the cover has the role of a "with compliments" card, a greetings card, a business card or the like. The function of the printing on the turned-over page 13 can be supplemented by printing on a clip 9.

Figure 8:
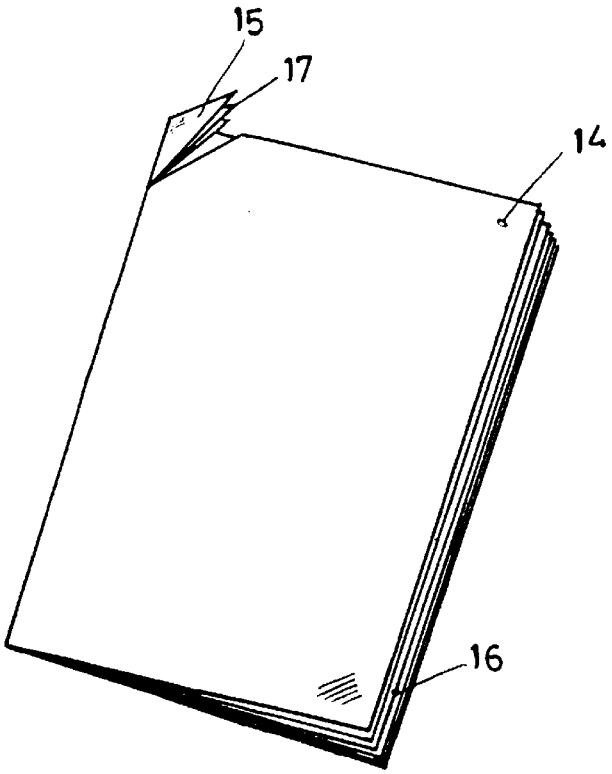
FIG. 8 shows another embodiment of the inventive idea, in the form of a booklet having incisions.

It can be seen from FIG. 8 that the inventive idea can not only be used on a cover but also con a complete stack of sheets of paper which may be printed on one or both sides. It is not only the outermost page 14 which is provided with an incision forming a lip 15—here shown in the same design as in FIGS. 1 and 2—but also all the internal pages 16 have corresponding incisions and corresponding lips 17. All the sheets 16 then have the same format as the outermost sheet or the cover 14, that is to say twice the final format of the bundle. If all these sheets are placed with the scored grooves or fold lines on top of one another and are folded inwards together in two, a simple booklet is formed. In accordance with the inventive idea, this can be held together by sliding a paper fastener over the stack of lips such as 15 and 17, possibly including the half which is situated past the centre and in which there is no incision (or the fastening can optionally be performed using a staple). In this case, the effect is again that the entire booklet is held together in the top left-hand corner, outside the printed page, and that the outermost page 14 or the cover and all the individual pages 16 inside can be opened along the spine.

In addition, it would be practical, if there are more than three or four sheets, to trim the right-hand edge of the booklet, in order to finish it off nicely.

In this way, a presentation can easily be provided which is in the form of a booklet and is adapted to the person for whom it is intended by suitably choosing the pages inserted which relate, for example, to products or services which are selected for a particular customer from a wider range.

An additional advantage of this embodiment is that a booklet can be made having a number of pages which is twice the maximum capacity of a paper fastener used. A fastener or clip as indicated by 9 in FIG. 3 can be obtained, for example, in a design which has a maximum capacity of 15 sheets. If, in accordance with FIG. 8, this clip is only slid onto the lips 15, 17 as far as the middle, the pages are held together well but it is possible in this manner to secure 15 pages, which give 30 double pages, thus a total of 60 printed pages.

Figure 9:
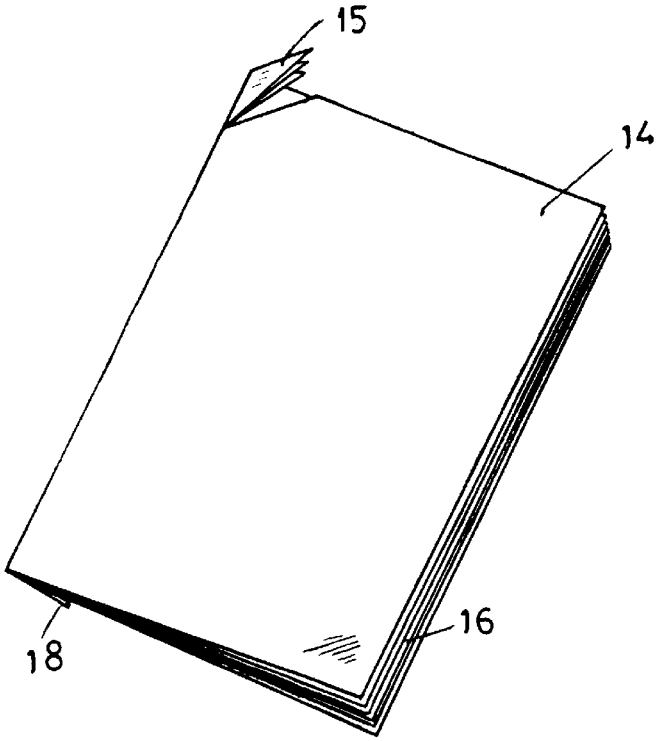
FIG. 9 shows a variant of this, which is likewise provided with incisions in the other half on the underside.

The booklet can be reinforced by making incisions or forming lips in a corresponding manner at the other end of the score or fold line, as indicated in FIG. 9 by 18. Accordingly this means that, in this case, each sheet is rotated about 180° about one axis or another and the cut is then made at the same location as defined above, for example with reference to FIG. 1.

If the bundle is folded in the manner depicted in FIG. 9, the fastener which is slid onto the bundle of lips 18 in the rear half of the booklet can be slid on such that text present on the fasteners, showing a name or an advertising message, becomes visible, after having leafed through the first half of the contents, when the text on the top clip always remains readable, on the underside throughout the period when the second half of the booklet is being leafed through.

I claim:

1. A cover suitable for sheets of paper which are to be held together comprising at least one score line such that folding along the at least one score line forms a spine, a front leaf and a back leaf, wherein a corner region of the front leaf near a top edge of the front leaf next to the at least one score line forms a lip part which is attached to the spine or back leaf, the lip part being separated from the remaining part of the front leaf by an incision running from the at least one score line in the direction of the top edge of the front leaf such that i) the remaining part of the front leaf can be opened about the spine;

ii) the lip part is suitable for positioning a paper fastening means for retaining sheets of paper between the lip part and the back leaf, and iii) the sheets of paper can be turned over about the lip part when the paper fastening means is operatively positioned on the lip part.

2. A cover according to claim 1, wherein the incision runs from the first score line to the top edge of the front leaf.

3. A cover according to claim 1, wherein the incision includes a first incision part running in the direction of the top edge and a second incision part which runs back towards the at least one score line.

4. A cover according to claim 1, wherein the back leaf is provided with a side flap and a bottom flap.

5. A cover according to claim 1, wherein an endpaper is present, provided with an incision which corresponds to the incision in the front leaf.

6. A cover according to claim 1, wherein the at least one score line comprises first and second score lines, the first and second score lines forming the spine.

7. A cover suitable for sheets of paper which are to be held together, which cover comprises at least one score line such that folding along the at least one score line forms a spine, a front leaf and a back leaf, wherein a corner region of the front leaf near a top edge next to the at least one score line is cut out by a first cut line running from the first score line in the direction of the top edge of the front leaf as far as said top edge and a second cut line which begins at the same position of the at least one score line as the first cut line and runs along the at least one score line to the top edge of the front leaf to form a cutout of the front leaf, such that i) the remaining part of the front leaf can be opened about the spine;

ii) the cutout is suitable for positioning a paper fastening means for retaining sheets of paper with respect to the back leaf; and iii) the sheets of paper can be turned over about the paper fastening means when the paper fastening means is operatively positioned over the cutout.

8. A cover according to claim 7, wherein an endpaper is present, provided with a cutout which corresponds to the cutout in the front leaf.

9. A cover according to claim 7, for use as a business card or as a "with compliments" card.

10. A cover according to claim 7, wherein the at least one score line comprises first and second score lines, the first and second score lines forming the spine.

11. A booklet comprising a bundle of sheets of paper being folded about a fold line to define a front leaf and a back leaf for each sheet of the bundle, each sheet including a lip part at a corner region of the front leaf near the top edge next to the fold line, the lip part of each sheet being attached to the back leaf at the fold line of the respective sheet, the lip part of each sheet being separated from the remaining part of the front leaf of each sheet by an incision running from the fold line in the direction of the top edge of the sheet such that:

i) the incision is made in a substantially identical manner in all sheets;

ii) the remaining part of the front leaf of each sheet can be opened about the fold line;

iii) the bundle of sheets including said lip parts is suitable for positioning a paper fastening means for holding the lip parts of the bundle of sheets together, and;

iv) each of the front leaf and back leaf of the bundle of sheets can be turned over about the fold line in the manner of a booklet when the paper fastening means is operatively positioned on the lip parts of the bundle of sheets.

12. A booklet according to claim 11, wherein each sheet is provided with an identical further incision for forming a further lip part at the other end of the fold line in the corner region of the back leaf of each sheet near a bottom edge of the sheet next to the fold line such that the bundle of sheets are symmetric with respect to a 180° rotation in a plane of the sheet.

13. A booklet as in claim 11, further including a cover folded about a fold line to define a front leaf and a back leaf, said cover including a lip part at a corner region of the front leaf near the top edge next to the fold line, the lip part of the cover begin attached to the back leaf at the fold line, the lip part being separated from the remaining part of the front leaf of the cover by an incision running from the fold line in the direction of the top edge of the cover in a substantially identical manner as in the sheets of said booklet, said cover positioned over said booklet.

* * * * *

UNITED STATES PATENT AND TRADEMARK OFFICE

CERTIFICATE OF CORRECTION

PATENT NO. : 5,957,501
DATED : September 28, 1999
INVENTOR(S) : Van Ardenne, Robertus It is certified that error appears in the above-identified patent and that said Letters Patent is hereby corrected as shown below:

Column 3,
Line 62, the printed patent incorrectly reads "corner region near the top edge, near the pine"; the patent should read --corner region near the top edge, near the spine --.

Column 5,
Line 42, the printed patent incorrectly reads "so that the entire contents a remain in application"; the patent should read --so that the entire contents 8 remain in application--

Signed and Sealed this

Twelfth Day of June, 2001

Nicholas P. Godici

*Attest:*

*Attesting Officer*

NICHOLAS P. GODICI
*Acting Director of the United States Patent and Trademark Office*